United States Patent [19]

Tokuhara et al.

[11] Patent Number: 5,006,088

[45] Date of Patent: Apr. 9, 1991

[54] METHOD OF MAKING A PINCH-SEALED, GAS-FILLED INCANDESCENT LAMP

[75] Inventors: Chikara Tokuhara, Shimizu; Tetsuro Hara, Nagano, both of Japan

[73] Assignees: Koito Manufacturing Co., Ltd., Shizuoka, Japan; Nissei Industries, Nagano, Japan

[21] Appl. No.: 442,768

[22] Filed: Nov. 29, 1989

[30] Foreign Application Priority Data

Dec. 1, 1988 [JP] Japan ..... 63-304950

[51] Int. Cl.[5] ..... H01J 9/32

[52] U.S. Cl. ..... 445/27; 445/43; 445/32; 65/32.2; 65/59.26; 65/59.28

[58] Field of Search ..... 445/42, 43, 27, 32; 65/32.2, 42, 59.26, 59.28

[56] References Cited

U.S. PATENT DOCUMENTS

| | | | |
|---|---|---|---|
| 2,945,327 | 7/1960 | Malm et al. | 65/42 |
| 3,265,923 | 8/1966 | Preziosi et al. | 65/32.2 |
| 4,749,901 | 6/1988 | Demas | 445/27 |

*Primary Examiner*—Kenneth J. Ramsey

*Attorney, Agent, or Firm*—Sughrue, Mion, Zinn, Macpeak & Seas

[57] ABSTRACT

A method of manufacturing an incandescent lamp which has a tube extending through the pinch seal of the glass envelope both for evacuating the same and for subsequently introducing a halogen gas therein. An envelope blank has its open end portion heated prior to pinch sealing, with a filament mount assembly inserted therein but with the gas exhaust/supply tube not inserted to preclude the possibility of its clogging. Only after the open end portion of the envelope blank has been heated to a viscid state is the gas exhaust/supply tube inserted therein. The envelope blank is pinch sealed immediately thereafter.

7 Claims, 3 Drawing Sheets

METHOD OF MAKING A PINCH-SEALED, GAS-FILLED INCANDESCENT LAMP

BACKGROUND OF THE INVENTION

Our invention relates to a method of making an incandescent lamp, particularly a baseless incandescent lamp having, instead, a hermetic pinch or press seal of fused vitreous material at one end. Typically, the baseless incandescent lamp to be fabricated by the method of our invention is of the known halogen cycle type, with a vitreous tube extending through the pinch seal for evacuating the interior of the lamp envelope and for introducing a halogen gas or the like into the evacuated envelope.

The baseless halogen-cycle incandescent lamp has been known and used extensively as, for example, a light source of vehicular headlamps. By the term "baseless lamp" we mean a lamp which includes a vitreous envelope formed by press- or pinch-sealing an open end of an envelope blank after inserting a mount assembly and a gas exhaust/supply tube in the open end of the envelope blank. The mount assembly includes a filament supported by a pair of lead wires. The gas exhaust/supply tube is used for subsequently evacuating the interior of the pinch sealed envelope and for introducing a halogen gas together with an inert fill gas into the evacuated envelope. Parts of the lead wires of the mount assembly, and part of the exhaust/supply tube, are both embedded in the pinch seal.

We will now explain the standard practice of the industry for the fabrication of such baseless lamps in order to make clear the problems to be solved by our invention.

The mount assembly and the gas exhaust/supply tube are both inserted in the open end of the envelope blank before the latter is heated. Then the open end portion of the envelope blank is heated to a moldable state, as by burners, while the envelope blank is being revolved about its own axis. As the envelope blank is thus heated, so are, of course, the amount assembly and the exhaust/supply tube inserted therein. Then the viscid end portion of the envelope blank is pinched to form the pinch seal fused to the exhaust/supply tube and also having the lead wires of the mount assembly embedded therein.

We object, in this conventional practice, to the simultaneous heating of the envelope blank and the exhaust/supply tube inserted therein. Heated to a viscid state with the envelope blank, the exhaust/supply tube has been susceptible to deformation upon pinch-sealing of the envelope blank. The tube has been easy to be clogged up or reduced in inside diameter to such an extent that a desired degree of vacuum is not created within the envelope when air is subsequently drawn out therefrom for a designated length of time.

We are aware of some suggestions heretofore made to overcome this problem. One is to insert a coil of heat-resistant wire in the exhaust/supply tube as a mandrel to prevent its deformation during pinch-sealing. Our objection to this suggestion is because of the added cost of the coil mandrel and the added task of inserting it into the tube and, after the pinch-sealing of the envelope blank, of withdrawing it for the evacuation of the completed lamp envelope.

Another known solution is to fabricate the lamp envelope and the tube from vitreous materials of improved compositions. Such improved vitreous materials are usually more expensive than ordinary vitreous materials and, moreover, impose limitations on the latitude of lamp design.

It is also known to blow a gas through the exhaust tube during the heating of the envelope blank to maintain its shape. Examples of such an approach are described in U.S. Pat. Nos. 3,932,164, 4,469,9893 and 4,749,901. This approach, however, has a drawback in that additional steps in the manufacturing process are required to connect and disconnect the tube to and from a gas supply. The efficiency of the process is thereby hindered and the costs increased.

SUMMARY OF THE INVENTION

In light of the above-discussed problems, we have hereby invented a method of fabricating a pinch-sealed incandescent lamp so as to avoid the deformation of the gas exhaust/supply tube inserted in the lamp envelope.

Briefly, our invention may be summarized as a method of making a pinch-sealed incandescent lamp to be evacuated and filled with a halogen gas or the like. According to the inventive method there are first prepared an envelope blank having an end portion defining an open end, and a gas exhaust/supply tube, both of which can be of vitreous material used ordinarily in the art. The exhaust/supply tube is, however, inserted in the end portion of the envelope blank not before, but after, the latter is heated to a moldable temperature. The heated end portion of the envelope blank is pinch-sealed immediately after the insertion of the exhaust/supply tube therein. The mount assembly, having a pair of lead wires supporting a filament, may be held inserted in the envelope blank during the heating of its end portion.

Experiment has proved that, inserted in the envelope blank after the latter has been heated, the gas exhaust/supply tube has only its surface portion fused and united with the envelope blank upon subsequent pinch-sealing. The inside diameter of the tube remains the same before and after the pinch-sealing. Thus the object of our invention can be accomplished without use of any means other than those conventionally used for bulb manufacture in the art, or of any expensive vitreous materials.

The above and other features and advantages of our invention and the manner of realizing them will become more apparent, and the invention itself will best be understood, from a study of the following description and appended claims, with reference had to the attached drawings showing the best mode of carrying out the invention.

DESCRIPTION OF THE PREFERRED EMBODIMENTS

Figure 1:
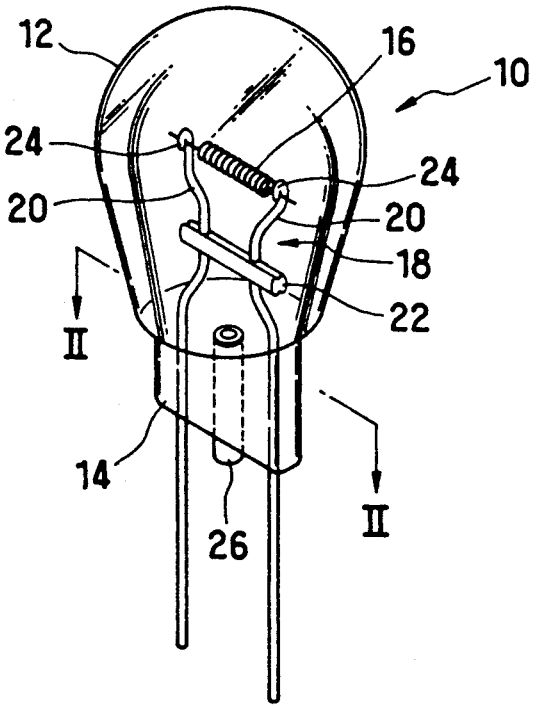
FIG. 1 is a perspective view of a typical form of pinch-sealed, gas-filled incandescent lamps to be manufactured by the method of our invention.

We will first describe the typical construction of an incandescent lamp to be manufactured by the method of our invention. With reference therefore to FIG. 1 the exemplified incandescent lamp illustrated therein and generally designated 10 is of the baseless, single-filament, halogen-cycle type. Included is, first of all, a vitreous envelope 12 of suitable high-temperature material terminating at one end in a pinch or press seal 14 hermetically sealing the envelope. The envelope 12 houses a tungsten filament 16 supported by a mount assembly 18. This mount assembly includes a pair of lead wires 20 extending through the pinch seal 14 in a parallel spaced relation to each other. Within the envelope 12 the lead wires 20 are rigidly interconnected by a vitreous bridge 22 which retains the lead wires at a proper spacing from each other. The filament 16 is supported by and between the crimped ends 24 of the lead wires 20.

Figure 2:
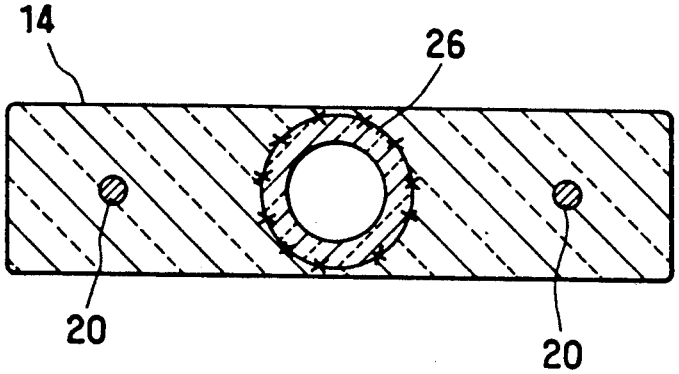
FIG. 2 is an enlarged cross section through the pinch seal of the incandescent lamp, taken along the line II—II in FIG. 1.

As illustrated cross-sectionally and on an enlarged scale in FIG. 2, a gas exhaust/supply tube 26 of the high-temperature vitreous material extends through the pinch seal 14, in a position intermediate the pair of lead wires 20, and is open at both ends to the interior and exterior of the envelope 12. The gas exhaust/supply tube 26 is intended for use both in evacuating the interior of the envelope 12 and in subsequently filling the same with a halogen together with a suitable inert gas. The outer end portion of the exhaust/supply tube 26, shown projecting from the pinch seal 14 in FIG. 1, is to be tipped off after the introduction of any desired gas into the envelope 12, which is then sealed hermetically.

We will now proceed to the detailed disclosure of the method of making the incandescent lamp 10 of the foregoing construction. Reference is directed for such disclosure to FIGS. 3A–3C which illustrate the sequential steps of the method.

Figure 3A:
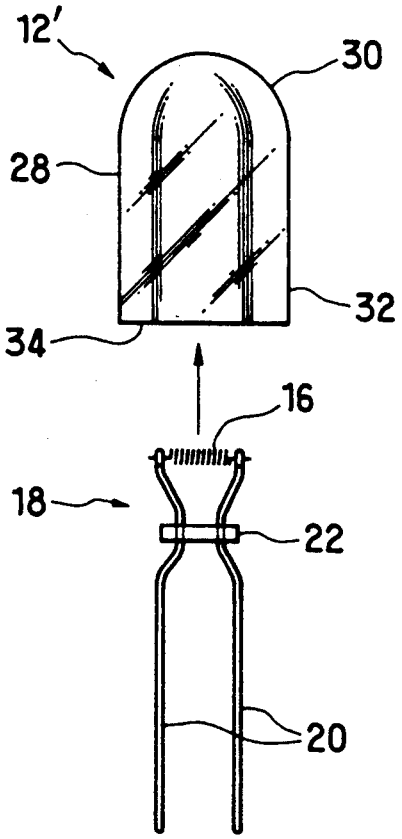
FIGS. 3A-3D are a series of sectional and elevational views showing the sequential steps of fabricating the incandescent lamp of FIG. 1 by the method of our invention.

There is first conventionally prepared a semifinished envelope blank 12' illustrated in FIG. 3A. The envelope blank 12' may be thought of as having a cylindrical major portion 28 terminating in a hemispherical closed-end portion 30 on one hand and, on the other hand, in a cylindrical open-end portion 32. This open-end portion defines an open end 24.

As shown also in FIG. 3A, the mount assembly 18 is also prepared which includes the pair of lead wires 20 supporting the filament 16 and rigidly interconnected by the bridge 22.

Figure 3B:
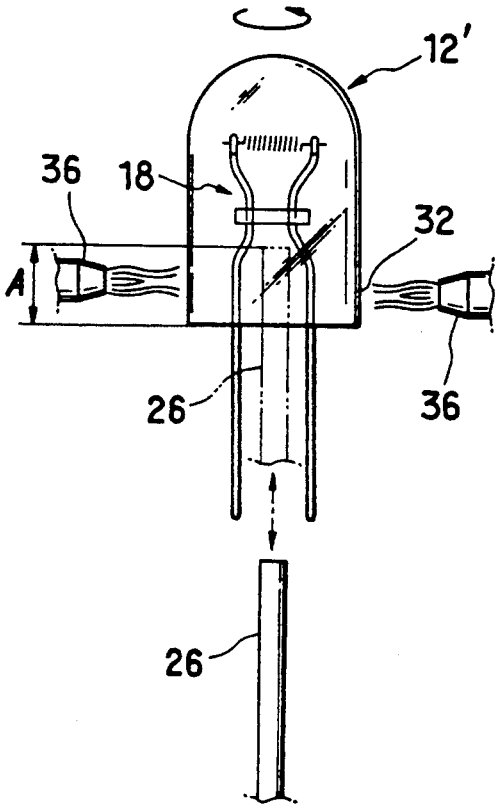

The next step, shown in FIG. 3B, is the heating of the open end portion 32 of the envelope blank 12' to a viscid state as by one or more burners 36. The envelope blank 12' may be revolved about its own axis relative to the burners 36 so as to evenly heat its open end portion 32 to a constant temperature. The mount assembly 18 is shown inserted in the envelope blank 12' through its open end 34 during this heating process. It is, of course, not essential that the mount assembly 18 be held inserted in the envelope blank 12' during the heating of its open end portion, all that is required being that the mount assembly be inserted in the envelope blank by the time of the subsequent pinch-sealing process.

What is more important in conjunction with the heating process of FIG. 3B is that the gas exhaust/supply tube 26 not be inserted in the envelope blank 12' during this process. We have explained earlier in this specification the inconveniences incurred by the conventional practice of holding this tube inserted in the envelope blank during the heating of its end portion.

Preferably, however, the exhaust/supply tube 26 should be preheated for the ease of adhesion to the envelope blank 12' during the subsequent pinch-sealing of its end portion 32. Unless preheated, the tube 26 might develop cavities at its interface with the envelope blank 12' during the pinch-sealing operation because of the difference in temperature therebetween. Such cavities might destroy the desired airtightness of the lamp envelope.

We recommend the preheating of the exhaust/supply tube 26 at the same time with the heating of the open end portion of the envelope blank 12'. As illustrated also in FIG. 3B, that portion A of the tube 26 which is to be embedded in the pinch seal of the lamp envelope may be passed through the open end of the envelope blank 12' a number of times determined by the pressure under which the envelope blank 12' is to be pinch sealed. Normally, the tube portion A may be passed through the open end of the envelope blank 12' from one to several times.

Figure 3C:
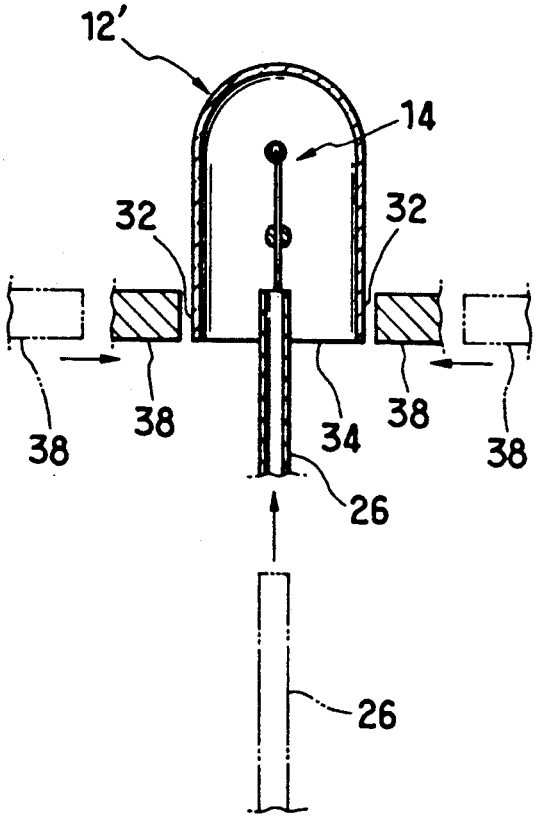

Next comes the step of pinch-sealing the end portion 32 of the envelope blank 12' by the conventional pincher device shown at 38 in FIG. 3C. The preheated exhaust/supply tube 26 may be inserted in the open end 34 of the envelope blank 12' to a required length, preferably from two to three seconds before pinch sealing. It is understood that the mount assembly 18 has been inserted in the envelope blank 12' throughout the heating operation of the envelope blank.

Figure 3D:
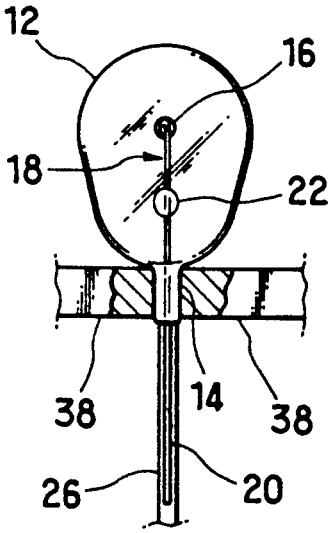

FIG. 3D shows the envelope blank 12' being pinch-sealed by the pincher device 38, with both mount assembly 18 and exhaust/supply tube 26 inserted therein. The envelope blank 12' and the exhaust/supply tube 26 will be firmly fused together under heat and pressure to form the pinch seal 14 constituting the base of the envelope 12. The pair of lead wires 20 of the mount assembly 18 will be hermetically embedded in this pinch seal 14.

Our invention features the fact that the exhaust/supply tube 26 is inserted in the envelope blank 12' immediately before pinch sealing. For this reason, the tube 26 will be fused to a relatively shallow depth from its surface by heat transfer from the envelope blank 12' and so will be properly united with the envelope blank, as indicated by the cross marks in FIG. 2, without the clogging or narrowing of the tube hole. This statement holds true if the tube 26 is preheated, because the tube is preheated only to such an extent as to avoid too much temperature difference between the two members.

Although we have shown and described our invention in very specific aspects thereof, we do not wish our invention to be limited by the exact details of such disclosure. A variety of modifications or adaptations may be made in the practice of our invention to conform to the specific requirements of each application of the invention. It is also to be understood that the illustrated construction of the incandescent lamp is by way of example only and is therefore subject to changes within the scope of our invention. For example, the pinch seal of the lamp need not be of rectangular cross-sectional shape as shown, but may, for example, be formed to include ribs around the exhaust/supply tube.

What is claimed is:

1. A method for producing a pinch-sealed incandescent lamp, comprising the steps of:

(a) providing an envelope blank of vitreous material having an open end portion;

(b) inserting a mount assembly comprising a pair of lead wires supporting a filament into said blank;

(c) heating said end portion to a temperature at which said end portion becomes moldable;

(d) inserting a gas exhaust/supply tube of vitreous material into said end portion after said end portion has reached said moldable temperature; and (e) pinch-sealing said end portion with said mount assembly and said gas exhaust/supply tube inserted therein.

2. The method of claim 1, further comprising the step of preheating said gas exhaust/supply tube prior to inserting said tube into said end portion of said blank.

3. The method of claim 2, wherein said step of preheating said gas exhaust/supply tube is performed simultaneously with said step (b) with a common heating means used to heat said end portion of said blank.

4. The method of claim 1, wherein said step (d) of inserting said mount assembly is performed prior to said step (b) of heating said end portion of said blank.

5. A method for producing a pinch-sealed incandescent lamp, comprising the steps of:

(a) providing an envelope blank of vitreous material having an open end portion;

(b) inserting a mount assembly comprising a pair of lead wires supporting a filament into said blank;

(c) heating said end portion to a temperature at which said end portion becomes moldable;

(d) inserting a gas exhaust/supply tube of vitreous portion of a time period during said heating of said end portion such that said tube is heated to a temperature less than a temperature at which said tube becomes viscid; and (e) pinch-sealing said end portion with said mount assembly and said gas exhaust/supply tube inserted therein.

6. The method of claim 5, wherein said step (d) comprises moving said gas exhaust/supply tube in and out of said envelope blank a plurality of times during said step (c) of heating said envelope blank.

7. The method of claim 5, wherein said step (d) of inserting said mount assembly is performed prior to said step (b) of heating said end portion of said envelope blank.

* * * * *

UNITED STATES PATENT AND TRADEMARK OFFICE

CERTIFICATE OF CORRECTION

PATENT NO. : 5,006,088

DATED : April 9, 1991

INVENTOR(S) : CHIKARA TOKUHARA ET AL.

It is certified that error appears in the above-identified patent and that said Letters Patent is hereby corrected as shown below:

Col. 6, lines 5 and 6, after "vitreous" insert --material into said end portion during only a predetermined--.

Signed and Sealed this

Eighteenth Day of August, 1992

*Attest:*

DOUGLAS B. COMER

*Attesting Officer*

*Acting Commissioner of Patents and Trademarks*